United States Patent [19]

Saltel et al.

[11] Patent Number: 4,982,454

[45] Date of Patent: Jan. 8, 1991

[54] TOILET SYSTEM COMPRISING A TOILET BOWL ASSOCIATED WITH A WATER FLUSH TANK

[75] Inventors: Claude Saltel; Daniel Petit, both of Revin, France

[73] Assignee: Etablissements Porcher, Paris, France

[21] Appl. No.: 357,732

[22] Filed: May 26, 1989

[30] Foreign Application Priority Data

May 26, 1988 [FR] France ..... 88 07010

[51] Int. Cl.[5] ..... E03D 5/00

[52] U.S. Cl. ..... 4/300; 4/420

[58] Field of Search ..... 4/300, 329, 353, 420, 4/421, 428

[56] References Cited

U.S. PATENT DOCUMENTS

| | | | |
|---|---|---|---|
| 1,142,249 | 6/1915 | Griffiths | 4/420 |
| 2,394,091 | 2/1946 | Merwin | 4/300 |
| 3,212,106 | 10/1965 | Noel | 4/421 |
| 3,591,868 | 8/1971 | Owens | 4/300 |
| 3,843,977 | 10/1974 | Garnett | 4/421 |
| 4,106,131 | 8/1978 | Delker | 4/420 |
| 4,234,975 | 11/1980 | Revels | 4/420 |

FOREIGN PATENT DOCUMENTS

| | | |
|---|---|---|
| 1658261 | 3/1972 | Fed. Rep. of Germany . |
| 2453302 | 5/1976 | Fed. Rep. of Germany . |
| 3315926 | 12/1983 | Fed. Rep. of Germany . |
| 8503964 | 9/1985 | PCT Int'l Appl. . |

*Primary Examiner*—Henry J. Recla
*Assistant Examiner*—Glenn T. Barrett
*Attorney, Agent, or Firm*—Cushman, Darby & Cushman

[57] ABSTRACT

This toilet system (1) includes a bowl (3) and a flush tank (4), which are molded of ceramic in one piece, the upper edge of the bowl (3) including an inverted channel (14) permitting the distribution of the flushing water over the entire surface of the bowl (3) and communicating with the tank (4) via a supply conduit (16), a distributor device (15) being inserted partly in the supply conduit (16) and partly in the adjacent zone of the channel (14). According to the invention, the supply conduit (16) comprises the bottom (17) of the tank (4) and includes bosses (24–25) separated by at least one throat (30) permitting the installation of the distributor (15) on the wall of the supply conduit (16). The tank (4) contains a pan (37), the bottom (38) of which rests on the bosses (24–25) and includes a central orifice (40) for evacuation of the water, which cooperates with a flushing mechanism (41) arranged to plug the orifice and resting on the bottom (38), the orifice (40) being disposed vertically of the upstream end (32*a*) of the distributor (15).

10 Claims, 2 Drawing Sheets

TOILET SYSTEM COMPRISING A TOILET BOWL ASSOCIATED WITH A WATER FLUSH TANK

FIELD OF THE INVENTION

The present invention relates to a flush toilet, comprising a toilet bowl associated with a flush tank.

In known system of this type, the bowl includes an inverted channel, opening downward, along its upper edge; as a consequence of the flushing action, the flushing water is propelled in the channel in two symmetrical streams beginning at the upstream region communicating with the tank, so that theoretically it will reach the downstream point farthest from the zone of origin of the water, that is, the tank.

BACKGROUND AND DESCRIPTION OF THE PRIOR ART

It is known that in a certain number of countries, specific standards must be met in terms of the rinsing of the toilet bowl surface by the flushing water; in Scandinavian countries, in particular, the requirement is that the entire surface be rinsed, while in other European countries, only several dozen square centimeters of the bowl, at most, are allowed not to be rinsed.

An embodiment is known in which the bowl is made of two pieces of ceramic material, glued together; one of the pieces is the bowl per se, while the other is a conduit forming the upper edge of the bowl and including orifices toward the bottom for distributing the water. This embodiment is expensive, and the reject rate in manufacture tends to be high, because of the difficulty of gluing the two pieces of ceramic material together.

In another known bowl, the channel is formed in a single piece with the bowl and has the cross section of an inverted U. The opening of the channel toward the bottom comprises a slit of as narrow a width as possible; it is even preferable to have a variable width from one end to the other of the path of the water, to assure suitable distribution. Since the outflow slit must be narrow, manufacturing problems arise, because the thickness of the walls of ceramic material, which are built up by depositing slip, is essentially a function of time and atmospheric conditions, and the width of the slit derives from the difference between a width that separates two walls of the mold and the thickness of the deposits on these two walls. It is apparent that if the slit must be quite narrow, it is very difficult to gain control over the constancy of the width. Once again, the result is a high reject rate in manufacture.

Bowls are likewise known in which the upper edge comprises a channel in the form of an inverted U that opens downward along a rather wide slit, to enable insertion of a distribution device into the part of the channel that is near the water supply. This distributor device is generally made of a flexible plastic material, because it is difficult to put in place. In fact, the zone that comprises the conduit for water for the bowl is a closed zone disposed vertically of the tank, and this closed zone is supplied through an orifice made in its wall.

In a first variant, the tank comprises a separate piece that is assembled to the bowl, which in turn includes its associated supply conduit molded with it. In a second variant, the tank is molded in one piece with the bowl, in which case the supply conduit comprises the zone included between the two walls forming the bottom of the tank; a double bottom at right angles with the tank in this manner is necessary because the lower part of the tank must include a wall to support the flushing mechanism that controls the delivery of water to the bowl. It can be seen that to install the distributor device, it must be introduced either via the source of supply to the conduit or via the slit of the channel where the supply conduit discharges. The upstream portion of the distributor device must be located in the supply conduit, and its two downstream branches must be disposed symmetrically in the channel (that is, symmetrically with respect to the common plane of symmetry of the bowl and tank), so that the distributor device is difficult to install, which increases the cost price of the toilet system. Moreover, the distributor device is necessarily short in length and so it has limited efficiency; it must also be flexible, so that the material comprising it is likely to deteriorate rather rapidly in contact with the flushing water.

SUMMARY OF THE INVENTION

The object of the present invention is to overcome these disadvantages in a set molded in a single piece, including a toilet bowl and its associated tank.

The proposal made by the present invention to attain this object comprises eliminating the double bottom of the tank and removing the wall that previously separated the conduit from the tank. It is thus easy to put the distributor device into place on the bottom of the conduit by introducing its two upstream, remote ends into the channel; the flushing mechanism is then supported via a pan of plastic material that is disposed inside the tank.

The placement of a pan of plastic material in the tank has already been disclosed per se in French Pat. No. 2 572 748; in that patent, however, such a pan had a completely different purpose, that is, to reduce noise, and it was used in a tank that was a separate piece from the bowl but connected to it.

Thus according to the invention, the advantage of manufacturing the toilet system by molding in a single piece including the bowl and its associated tank is retained, and a distributor device of rigid or semirigid material and hence having a long service life, and with distributing downstream branches as long as desired and hence having optimal efficiency for rinsing the entire bowl with the flushing water, can be installed without difficulty.

Hence the subject of the present invention is the novel industrial product, comprising a toilet system embodied by a toilet bowl associated with a flush tank, the set being molded in a single ceramic piece, the bowl including an inverted channel along its upper edge permitting the distribution of the flushing water over the entire surface of the bowl and communicating with the tank via a supply conduit that assures the communication between the tank and the bowl, and a distributor device being inserted partly in the supply conduit and partly in the adjacent zone of the channel to assure the flow of the flushing water up to the portion of the channel that is farthest from the tank, the tank containing a flushing mechanism, controlled by a operating device, and being closed in its upper portion by a lid, characterized in that the supply conduit comprises the bottom of the tank and includes bosses separated via at least one throat, which throat or throats permit the installation on the wall of the supply conduit of the distributor device, the downstream ends of which are engaged symmetrically in the channel and the upstream end of which is vertical of the central zone of the tank; that the tank contains a pan the bottom of which rests on the bosses of the supply conduit, and the central portion of the bottom of the pan includes an orifice for evacuation of the water that cooperates with a flushing mechanism arranged to plug the orifice; and that the base of the flushing mechanism rests on the bottom of the pan, with the orifice disposed vertically of the upstream end of the distributor device.

The distributor device is advantageously embodied of a semirigid plastic material; preferably it has the form of a chute of semicircular cross section, open on its top part, and it may include openings or notches in its lower part permitting the outflow of the water.

Moreover, it may be provided that the inverted channel formed along the upper edge of the bowl opens in the direction of the bottom of the bowl along a slit of substantially constant width.

The bottom of the pan received in the tank of the toilet system according to the invention may also rest on the upstream end of the distributor device.

In accordance with particular features of the toilet system of the present invention, the pan carries the water supply faucet of the pan in the vicinity of its upper edge, and the communication between the faucet and the supply system is effected via flexible piping; the tank lid carries the operating device for the flushing mechanism, which may be a pushbutton, the actuation of which controls the displacement of an element of the flushing mechanism counter to the action of a restoring spring; and the connection between the pushbutton and the aforementioned element is a simple pressure rest.

BRIEF DESCRIPTION OF THE DRAWINGS

For better comprehension of the subject of the present invention, an embodiment shown in the accompanying drawing will be described below, by solely illustrative and non-limiting example.

In the drawing.

DETAILED DESCRIPTION OF THE INVENTION

Figure 1:
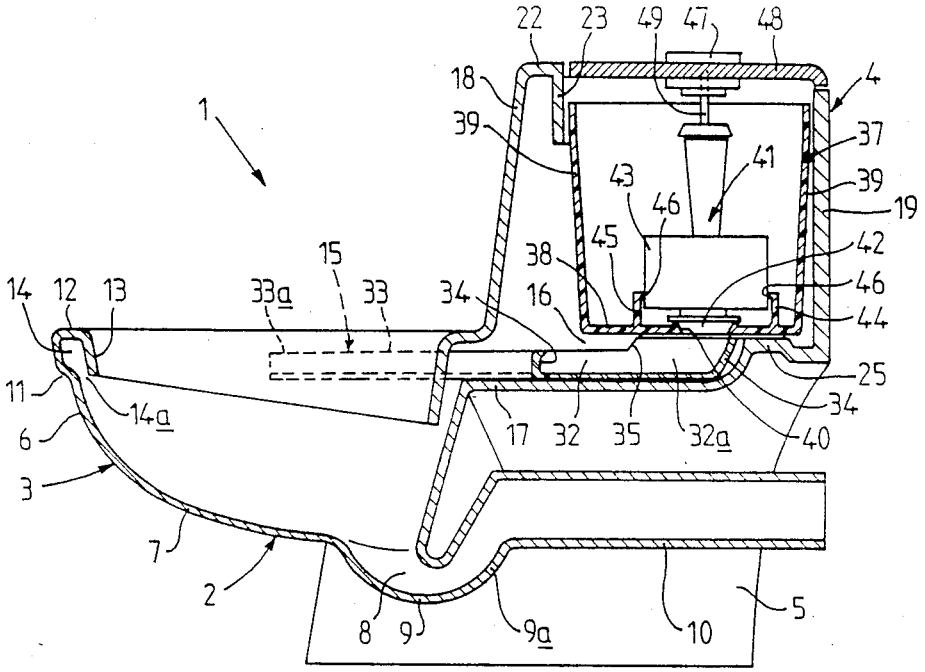
FIG. 1 is a longitudinal axial sectional view of the system according to the invention.
Figure 2:
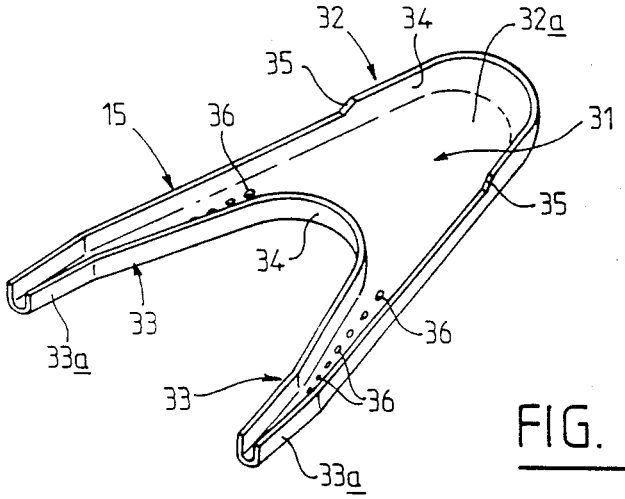
FIG. 2 is a perspective view of the distributor device with which the system of FIG. 1 is equipped.
Figure 3:
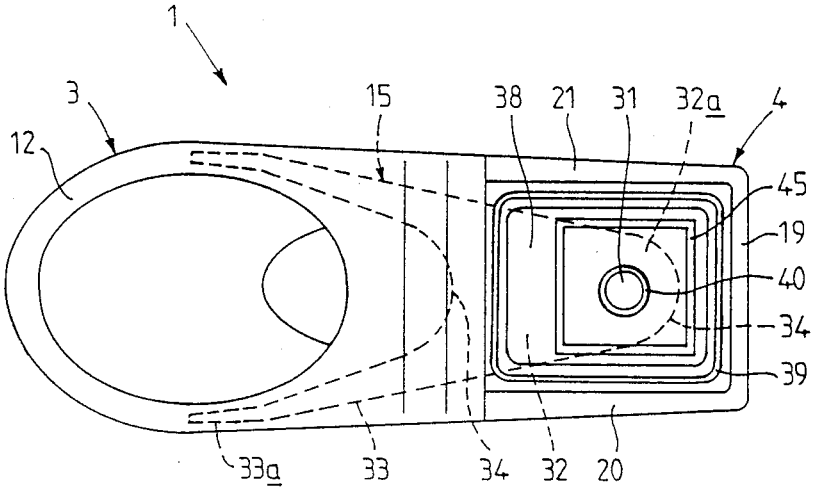
FIG. 3 is a top view of the system of FIG. 1, without its lid and without its flushing mechanism.

Turning to the accompanying drawing, it is seen that reference numeral 1 represents a complete flush toilet in accordance with the present invention.

This system includes, in a known manner, a set 2 molded in one piece, from a single piece of ceramic material, and embodied by a bowl 3 connected via its upper rear portion to a flush tank 4. The set 2 rests on the floor via a pedestal 5.

The bowl 3 has a generally standard form. It comprises a lateral wall 6 connected to an inwardly curved bottom 7. The latter has an opening 8 at its rear end, bordered on the outside by an elbow pipe 9, the outlet branch 9a of which, rising with respect to the lateral wall 6, is bifurcated toward the back to form a horizontal conduit 10 for evacuation of the water.

In the vicinity of the upper edge of the bowl 3, a slight oblique offset 11 of its lateral wall 6 is formed, and along this edge, this wall is bent initially at a right angle toward the interior to make a horizontal support surface 12, and then is bent again toward the interior to comprise a skirt 13, the length of which increases progressively from the front to the back of the bowl 3. On the periphery of the bowl 3, the result is a channel 14 in the form of an inverted U, into which the flushing water is supplied along two opposed paths from the back toward the front, beginning at a distributor device 15, which is described below. The channel 14 opens in the direction of the bottom of the bowl along a slit 14a of substantially constant width.

In the upper rear portion, the bowl 3 is extended via the tank 4, with the zone of communication between the bowl 3 and tank 4, embodied as a supply zone, being designated by reference numeral 16.

The tank 4 is defined by a substantially horizontal bottom 17, connected to the rear region of the lateral wall 6; by a front wall 18 that is slightly inclined toward the rear of the bowl 3; by a vertical rear wall 19; and by two likewise vertical lateral walls 20 and 21. The front wall 18 and the lateral walls 20 and 21 are bent along their upper edge to comprise a horizontal rim 22 and then a vertical internal skirt 23.

Figure 4:
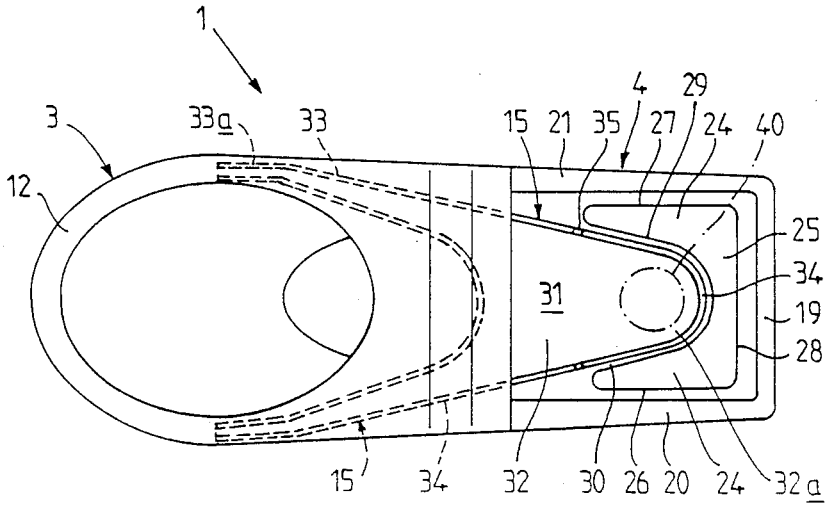
FIG. 4 is a view similar to FIG. 3, with the pan of plastic material removed.

As can be seen in FIGS. 1 and 4, the bottom 17, perpendicular to the walls 20 and 21, includes two lateral bosses 24 joined by a rear boss 25. The set of these bosses 24 and 25 has the general shape of a U and is obtained in molding via a single bulge of the bottom 17; it extends substantially over the rear three-quarters of the bottom 17, and it is defined by three rectilinear edges 26, 27 and 28 that are parallel to the lateral edges and to the rear edge of the bottom 17, respectively, and are spaced slightly apart from the respective edges of this bottom 17, and by a front edge 29 in the form of a U with flared legs. Between the two bosses 24, a throat 30 is thus formed, enabling the installation of the distributor device 15.

The latter, embodied of a semirigid plastic material, comprises a flat bottom 31 defined between a first edge, having the form of a U with flared and elongated legs, and a second edge, likewise in the form of a U, that has more highly flared and shorter legs and is inscribed in the first edge. The flat bottom 31 is bent upward along the aforementioned two edges in such a way as to comprise a relatively flat upstream receptacle 32 that is extended in the form of two downstream chutes 33 having the cross section of a U, which are slightly narrower in the two end zones 33a.

In the assembled position of the toilet system 1, the distributor device 15 rests via its upstream receptacle 32 on the bottom 17 of the tank 4; the chutes 33, with their free ends 33a, are engaged symmetrically in the channel 14, in such a way as to extend over substantially half the length of the bowl 33.

The rim 34 of the distributor device 15 has a greater height in the region 32a of the receptacle 32 intended to occupy the space of the throat 30; the entire remaining region, of lesser height, is connected to this end region along two oblique offsets 35, which are symmetrical with respect to the central longitudinal line of the distributor device 15.

Moreover, openings 36 disposed in a line are formed in the bottom of each of the chutes 33 of this distributor device 15, in the intermediate region between the receptacle 32 and the end zones 33a.

The tank 4 contains a pan 37, made of a rigid or semirigid plastic material, of substantially parallelepiped shape, which is completely open at the top. Thus the pan 37 is defined by a bottom 38 and by four lateral walls 39 flaring slightly from this bottom 38. The height of the lateral walls 39 is such that in the assembled position of the toilet system 1, the upper end of the pan 37 is located facing the base of the skirt 23 of the tank 4, with the bottom 38 of this pan 37 resting on the bosses 24–25 of the supply conduit 15 and on the upper edge of the upstream end portion 32*a* of the receptacle 32 of the distributor device 15.

In its central portion, the bottom 38 of the pan 37 includes a circular orifice 40 for evacuation of the water, which cooperates with a standard flushing mechanism, identified in its entirety by reference numeral 41, the conical end portion 42 of which comprises the movable valve part, and the seat of which comprises one edge of the orifice 40. The latter is located vertically of the bottom 31 of the upstream portion 32*a* of the receptacle 32 of the distributor device 15.

The base 43 of the flushing mechanism 41 rests on the bottom 38 of the pan 37; it is seated in a receptacle 44 of corresponding shape, in this case square, defined by the portion of the bottom 38 surrounding the orifice 40, and by four lateral walls 45 of low height carrying an internal flange 46 along its free edge in order to hold the base 43 of the mechanism 41.

The latter is controlled by an operating device 47, comprising a pushbutton carried by a lid 48, intended to close off the top of the tank 4 when placed at the level of the rim 22 of the tank. The pushbutton 47 controls the displacement of an element 49 of the mechanism 41 counter to the action of a restoring spring (not shown).

In the vicinity of its upper edge, the pan 37 has a water supply faucet (not shown); the communication of this faucet with the water supply system is effected via flexible piping.

The assembly of the toilet system that has been described above is particularly simple to accomplish:

The set molded 2, via the upper free opening of the tank 4 the distributor device 15 is introduced and assumes its place on the supply conduit 16, with its two downstream chutes 33 disposed respectively in the two rear lateral portions of the channel 14 of the bowl 3. Next, the pan 37 is installed, resting on the bosses 24–25 and on the upper rim of the upstream portion 32*a* of the receptacle 32 of the distributor device 15. Finally, the flushing mechanism 41 is installed in the pan, and the tank is closed with the lid 48, with the pushbutton 47 resting on the element 49 of the mechanism 41 by a simple pressure rest.

When the flushing mechanism is operated, the water in the pan 37 is sent through the orifice 40 in the direction of the receptacle 32 of the distributor device 15. The water can spill over from this flat receptacle 32, but two lateral streams still remain, flowing toward the downstream portion via the chutes 33; given the optimal length of the chutes, this permits the propulsion of the water in the channel 14 as far as the front of the bowl 4. In this way, the entire bowl is rinsed, since some of the water flows via the openings 36 made in the bottom of the chutes 33, so that rinsing of the two lateral rear portions of the bowl is simultaneously assured.

It will be understood that the embodiment described above is in no way limiting and can be modified in any desirable way, without departing from the scope of the invention.

We claim:

1. A toilet system comprising a toilet bowl associated with a water flush tank, said system being molded in a single ceramic piece, said bowl including an upper edge having an inverted channel surrounding an opening of said bowl and facing an interior surface of said bowl, a supply conduit communicating said tank with said inverted channel, a distributor device having one portion inserted in said supply conduit and another portion disposed in said channel for facilitating the flow of liquid from said tank throughout said channel, said tank having an open top and a lid for closing said top, said tank having a bottom wall which constitutes said supply conduit and which includes bosses separated by a throat receiving said one portion of said distributor device, said another portion including spaced apart ends disposed each in a section of said inverted channel in symmetrical relation to one another, said one portion of said distributor device being disposed vertically below said tank, said tank including a pan having a bottom engaging said bosses, said bottom having a centrally located orifice for discharge of the contents of said pan, said tank having flushing means movable between an actuated position where said orifice is opened to permit discharge therethrough and a deactuated position where said orifice is closed to block discharge therethrough, said orifice being disposed vertically above said one portion of said distributor device.

2. A toilet system as defined by claim 1, characterized in that the distributor device is made of a semirigid plastic material.

3. A toilet system as defined by one of claims 1 or 2, characterized in that the distributor device has the form of a chute of semicircular cross section that is open on top.

4. A toilet system as defined by claims 1 or 2, characterized in that the distributor device includes openings on said another portion that permit the outflow of the water.

5. A toilet system as defined by claims 1 or 2, characterized in that the channel opens in the direction of a bottom of the bowl along a slit of substantially constant width.

6. A toilet system as defined by claims 1 or 2, characterized in that the bottom of the pan rests on the said one portion of the distributor device.

7. A toilet system as defined by 1 or 2, characterized in that the pan is of rigid plastic material.

8. The toilet system as claimed in claims 1 or 2 wherein the lid of the tank carries an operating device for said flushing means.

9. The toilet system as claimed in claim 8 wherein said operating device of said flushing means is a pushbutton and said flushing means includes a displaceable element connected to said pushbutton for movement against the action of a restoring spring.

10. The toilet system as claimed in claims 1 or 2 characterized in that the pan is of semirigid plastic material.

* * * * *